US005833060A

United States Patent [19]

Draghetti et al.

[11] Patent Number: 5,833,060

[45] Date of Patent: Nov. 10, 1998

[54] RIGID HINGED-LID PACKET FOR ELONGATED ELEMENTS

[75] Inventors: Fiorenzo Draghetti, Medicina; Eros Stivani, Bologna, both of Italy

[73] Assignee: G.D Societa' Per Azioni, Bologna, Italy

[21] Appl. No.: 718,677

[22] Filed: Sep. 24, 1996

[30] Foreign Application Priority Data

Sep. 25, 1995 [IT] Italy ..... BO95A0445

[51] Int. Cl.[6] ..... A45F 15/00

[52] U.S. Cl. ..... 206/268; 206/273

[58] Field of Search ..... 206/268, 265, 206/271, 273; 229/108, 160.1

[56] References Cited

U.S. PATENT DOCUMENTS

| | | | |
|---|---|---|---|
| 2,523,251 | 9/1950 | Pantalone et al. | 229/16 |
| 4,753,384 | 6/1988 | Focke et al. | 229/160.1 |
| 5,044,550 | 9/1991 | Lamm | 229/160.1 |
| 5,143,282 | 9/1992 | Pham | 229/160.1 |

FOREIGN PATENT DOCUMENTS

| | | |
|---|---|---|
| 36 243 345 A1 | 1/1988 | Germany . |
| 2 175 884 | 10/1986 | United Kingdom . |

*Primary Examiner*—David T. Fidei

*Attorney, Agent, or Firm*—Marshall, O'Toole, Gerstein, Murray & Borun

[57] ABSTRACT

A rigid hinged-lid packet for elongated elements, the packet being defined by a cup-shaped bottom container and by a cup-shaped lid hinged to an open top end of the container so as to rotate between an open and a closed position wherein the container is respectively open and closed; the packet being substantially in the form of a parallelepipedon presenting at least one beveled transverse edge.

7 Claims, 6 Drawing Sheets

RIGID HINGED-LID PACKET FOR ELONGATED ELEMENTS

BACKGROUND OF THE INVENTION

The present invention relates to a rigid hinged-lid packet for elongated elements.

The present invention is particularly advantageous for producing packets of cigarette, to which the following description refers purely by way of example.

Rigid hinged-lid packets of cigarettes are normally in the form of a rectangular parallelepipedon with sharp edges, which not only cause damage to clothing material coming into contact with the packet, but also act as stress concentrators.

SUMMARY OF THE INVENTION

It is an object of the present invention to provide a rigid hinged-lid packet designed to at least partly overcome the above drawbacks.

It is a further object of the present invention to provide a rigid hinged-lid packet, which may be produced from a smaller amount of paper than that required by a similar parallelepiped packet.

According to the present invention, there is provided a rigid hinged-lid packet for elongated elements, the packet comprising a cup-shaped bottom container and a cup-shaped lid, and the lid being hinged to an open top end of the container so as to rotate between an open position and a closed position respectively opening and closing the container; characterized in that the packet is substantially in the form of a parallelepipedon with at least one beveled transverse edge.

Preferably, said beveled transverse edge is a flat beveled transverse edge defined by an oblique flat strip at 45° to two adjacent walls of the packet.

Alternatively, said beveled transverse edge is a rounded beveled transverse edge defined by a curved-cross-section strip connecting two adjacent walls of the packet.

BRIEF DESCRIPTION OF THE DRAWINGS

A number of non-limiting embodiments of the present invention will be described by way of example with reference to the accompanying drawings, in which.

DETAILED DESCRIPTION OF THE INVENTION

Figure 1:
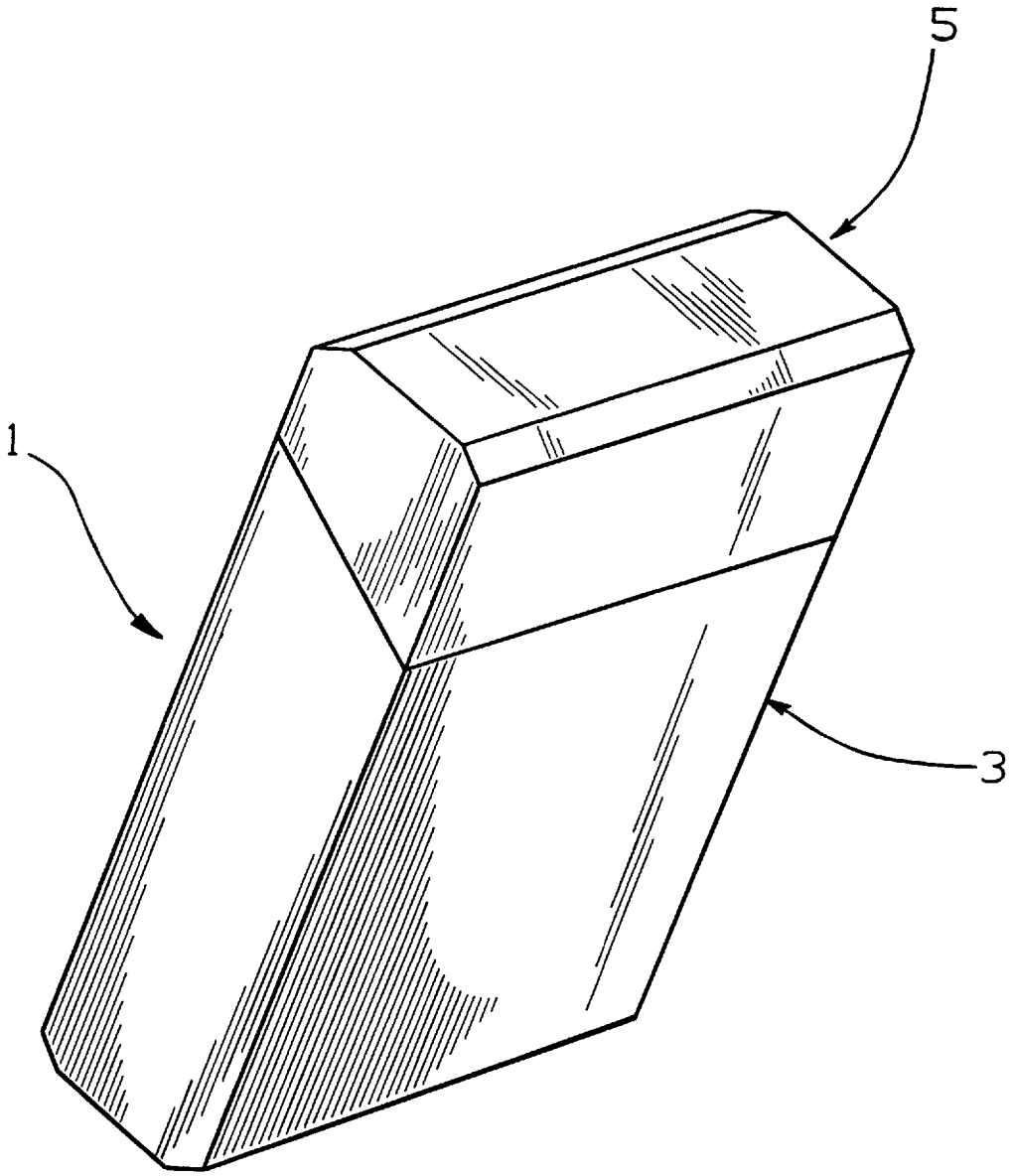
FIG. 1 shows a view in perspective of a first preferred embodiment of the packet according to the present invention and in the closed position.
Figure 2:
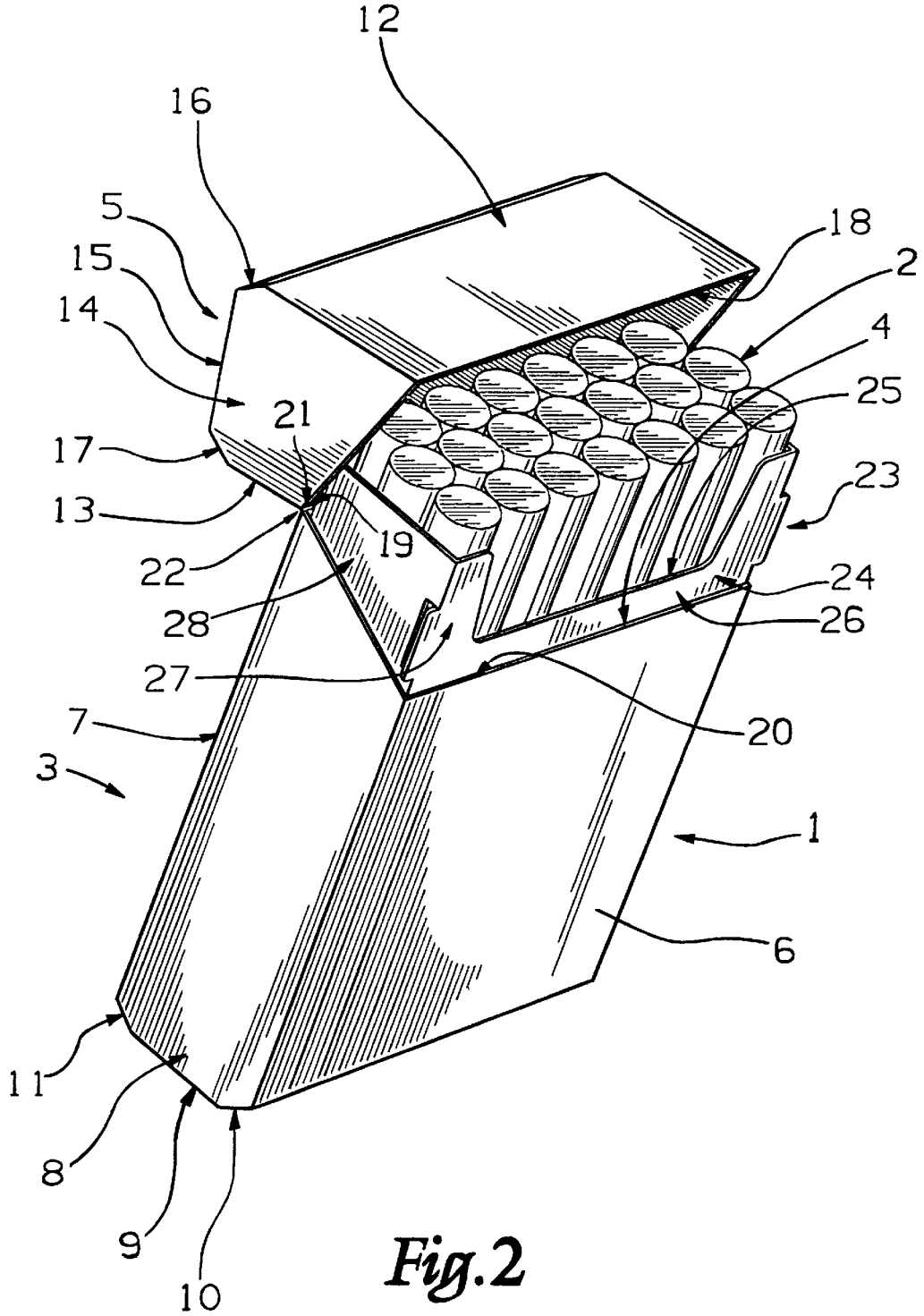
FIG. 2 shows a view in perspective of the FIG. 1 packet in the open position.

With reference to FIGS. 1 and 2, number 1 indicates a rigid packet for housing a group of cigarettes 2, and which comprises a cup-shaped bottom container 3 presenting an open top end 4; and a cup-shaped top lid 5 hinged to container 3 so as to rotate between an open position and a closed position respectively opening and closing end 4.

Container 3 presents a front wall 6 and a rear wall 7 facing and parallel to each other; two lateral walls 8 parallel to each other and perpendicular to walls 6 and 7; a bottom wall 9 perpendicular to walls 6, 7 and 8; and two connecting walls 10 and 11 perpendicular to walls 8 and respectively defining an oblique 45° beveled transverse edge connecting walls 6 and 9, and an oblique 45° beveled transverse edge connecting walls 7 and 9.

Lid 5 presents a front wall 12 and a rear wall 13 facing and parallel to each other; two lateral walls 14 parallel to each other and perpendicular to walls 12 and 13; a top wall 15 perpendicular to walls 12, 13 and 14; and two connecting walls 16 and 17 perpendicular to walls 14 and respectively defining a 45° bevel connecting walls 12 and 15, and a 45° bevel connecting walls 13 and 15. Walls 12 and 13 present respective free edges 18 and 19 respectively facing the free edge 20 of wall 6 and the free edge 21 of wall 7; and edge 21 is integral with edge 19 with which it defines a hinge 22 by which to rotate lid 5 between said open and closed positions.

Packet 1 also comprises a U-shaped collar 23 projecting partly outwards of end 4, and in turn comprising a central wall 24 with a central cavity 25 facing lid 5 and defining, on wall 24, a sunken central portion 26, and two lateral wings 27 extending towards lid 5. Wall 24 is connected to the inner surface of wall 6, from which portion 26 and wings 27 project partly, and is connected to two lateral walls 28 integral with the inner surfaces of respective walls 8 and projecting partly from respective walls 8 towards lid 5.

Figure 3:
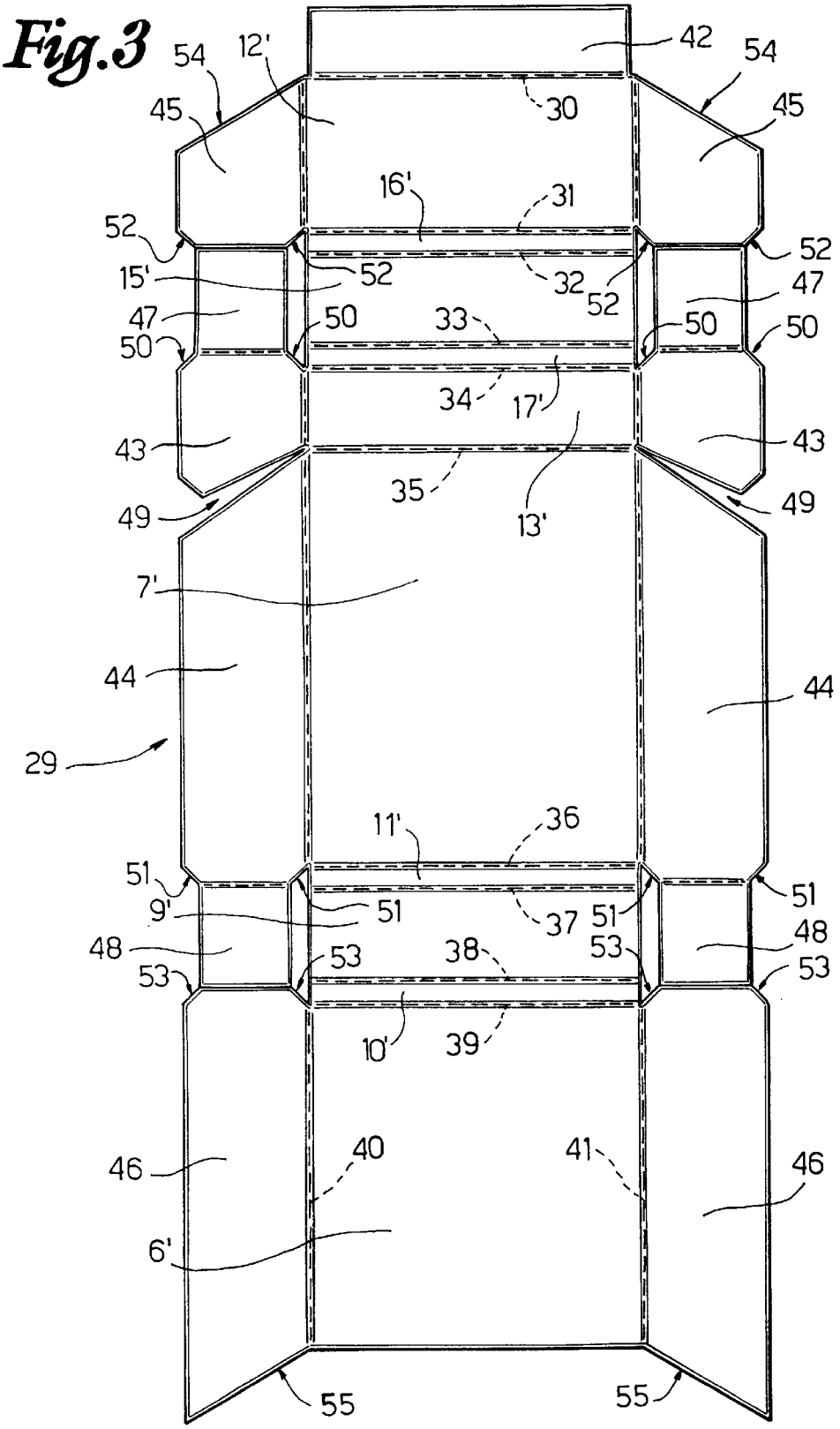
FIG. 3 shows a spreadout view of a blank from which to form the FIG. 1 packet.

As shown in FIG. 3, packet 1 is formed, by way of example, from a flat, substantially elongated rectangular blank 29, the component parts of which are indicated, wherever possible, using the same reference numbers, plus a (′), as for the corresponding parts of packet 1.

As shown in FIG. 3, blank 29 is substantially in the form of an elongated rectangle of much the same shape as a standard blank from which to form rigid hinged-lid packets, and presents a number of preformed transverse bend lines 30–39 and two preformed longitudinal bend lines 40, 41. Together with lines 40 and 41, lines 30–39 define a number of panels, which, wherever possible, are indicated using the same reference numbers, plus a (′), as for the corresponding walls of packet 1.

Between lines 40 and 41, lines 30–39 define a first end panel 12′ extending between lines 30 and 31; a strengthening tab 42 integral with panel 12′ along line 30; a first intermediate panel 15′ extending between lines 32 and 33; a second intermediate panel 13′ extending between lines 34 and 35 and smaller in height than panel 12′; two small panels 16′ and 17′ respectively connecting panel 12′ to panel 15′, and panel 15′ to panel 13′; a central panel 7′ extending between lines 35 and 36; a third intermediate panel 9′ extending between lines 37 and 38; a second end panel 6′ extending from line 39; and two panels 10′ and 11′ of the same height as panels 16′ and 17′, and for respectively connecting panel 6′ to panel 9′, and panel 9′ to panel 7′.

Each line 40, 41 defines, outwards of panels 12′, 13′, 7′ and 6′, respective tabs 45, 43, 44 and 46; and tabs 43 on either side of panel 13′ present respective longitudinal appendixes 47 connected to respective tabs 43 along respective transverse end edges substantially aligned with line 33. Similarly, tabs 44 on either side of panel 7′ present respective longitudinal appendixes 48 connected to respective tabs 44 along respective transverse end edges substantially aligned with line 37; and each tab 43 is separated from respective tab 44 by an oblique, substantially triangular slit 49.

Line 35 defines hinge 22; tabs 44 and 46 are folded squarely in relation to respective panels 7' and 6', and each tab 44 and a respective tab 46 are superimposed to define a portion of a respective lateral wall 8 of container 3 by rotating panels 6' and 7' towards each other and squarely in relation to panel 9'; and appendixes 48 are folded squarely in relation to respective tabs 44, and are rotated, together with tabs 44, onto the inner surface of panel 9' with which they define wall 9. Similarly, tabs 45 and 43 are folded squarely in relation to respective panels 12' and 13', and each tab 45 and a respective tab 43 are superimposed to define a respective lateral wall 14 of lid 5 by rotating panels 12', 16' and 13', 17' towards each other and in relation to panel 15'; and appendixes 47 are folded squarely in relation to respective tabs 43, and are rotated, together with tabs 43, onto the inner surface of panel 15' with which they define wall 15.

In connection with the above, it should be pointed out that the width of appendixes 47 and 48 is less than the width of respective tabs 43 and 44, and is approximately equal to but no greater than the height of respective panels 15' and 9'; each tab 43 presents, along said respective transverse end edge, two bevels 50 extending at 45° between lines 33 and 34 and connecting tab 43 to respective appendix 47; each tab 44 presents, along said respective transverse end edge, two bevels 51 extending at 45° between lines 36 and 37 and connecting tab 44 to respective appendix 48; each tab 45 presents, along a respective further transverse end edge facing said transverse end edge of tab 43 and adjacent to line 32, two end bevels 52 extending at 45° between lines 31 and 32; and each tab 46 presents, along a respective further transverse end edge facing said transverse end edge of tab 44 and substantially adjacent to line 38, two bevels 53 extending at 45° between lines 38 and 39.

Each tab 45 is defined, on the opposite side to line 32, by an oblique edge 54 converging with the other edge 54 towards tab 42, and is defined longitudinally by an outer longitudinal edge parallel to and on the opposite side of tab 45 in relation to respective line 40, 41; and each tab 46 extends beyond the free end of panel 6', is defined, on the opposite side to line 38, by an oblique edge 55 parallel to respective edge 54, and is defined longitudinally by an outer longitudinal edge parallel to and on the opposite side of tab 46 in relation to respective line 40, 41.

It should be pointed out that, at the end of the above folding operation, bevels 50 and 52 are superimposed to define shaped edges for lateral walls 14, and extend along, but are detached from, respective end edges of respective oblique flat strips defined by panels 17' and 16'. Similarly, bevels 51 and 53 are superimposed to define shaped edges of lateral walls 8, and extend along, but are detached from, respective end edges of respective oblique flat strips defined by panels 11' and 10'. And since the width of appendixes 47 and 48 is less than the height of panels 15' and 9', packet 1 is open at bevels 50, 52 and 51, 53 respectively.

Due to the presence of connecting panels 10', 11', 16' and 17', the length of blank 29 is less than that of a standard blank for producing a corresponding parallelepiped packet.

The above folding operation of blank 29 obviously only provides for forming container 3 and lid 5, so that collar 23 must be folded separately and subsequently made integral with container 3. Alternatively, blank 29 may obviously be modified so as to incorporate collar 23.

In the example shown, collar 23 is of the type commonly used for rectangular-section packets of cigarettes.

Figure 4:
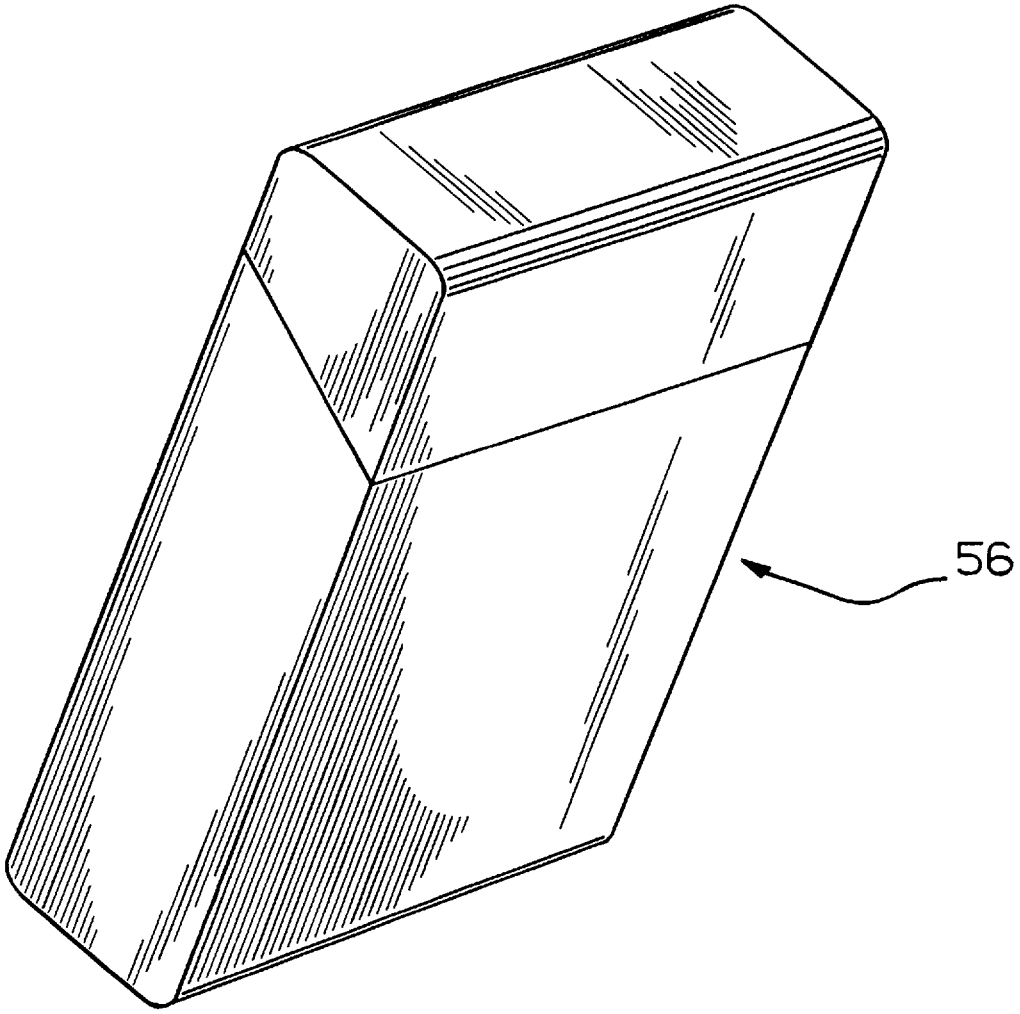
FIG. 4 shows a view in perspective of a second embodiment of the packet according to the present invention and in the closed position.
Figure 5:
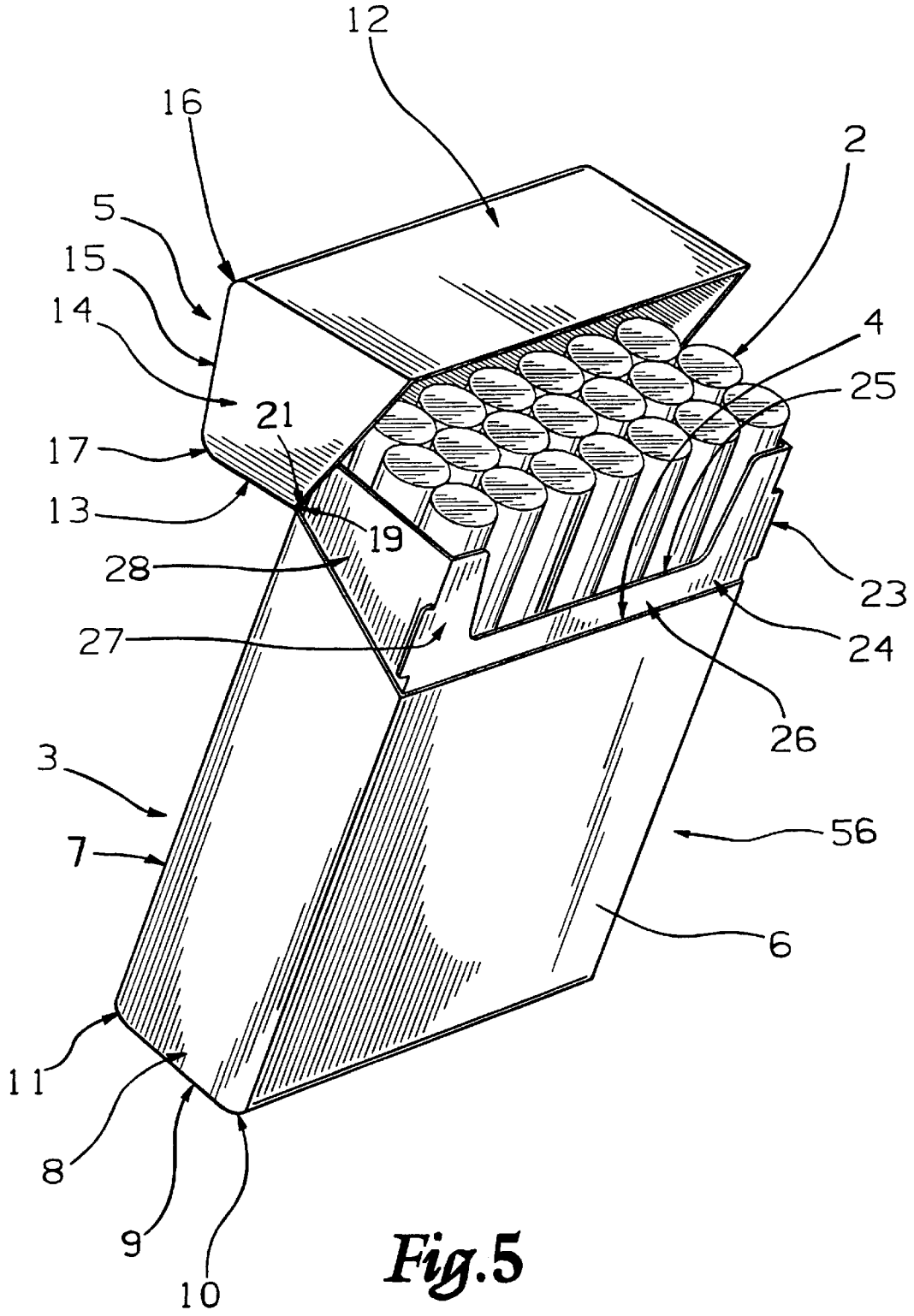
FIG. 5 shows a view in perspective of the FIG. 4 packet in the open position.
Figure 6:
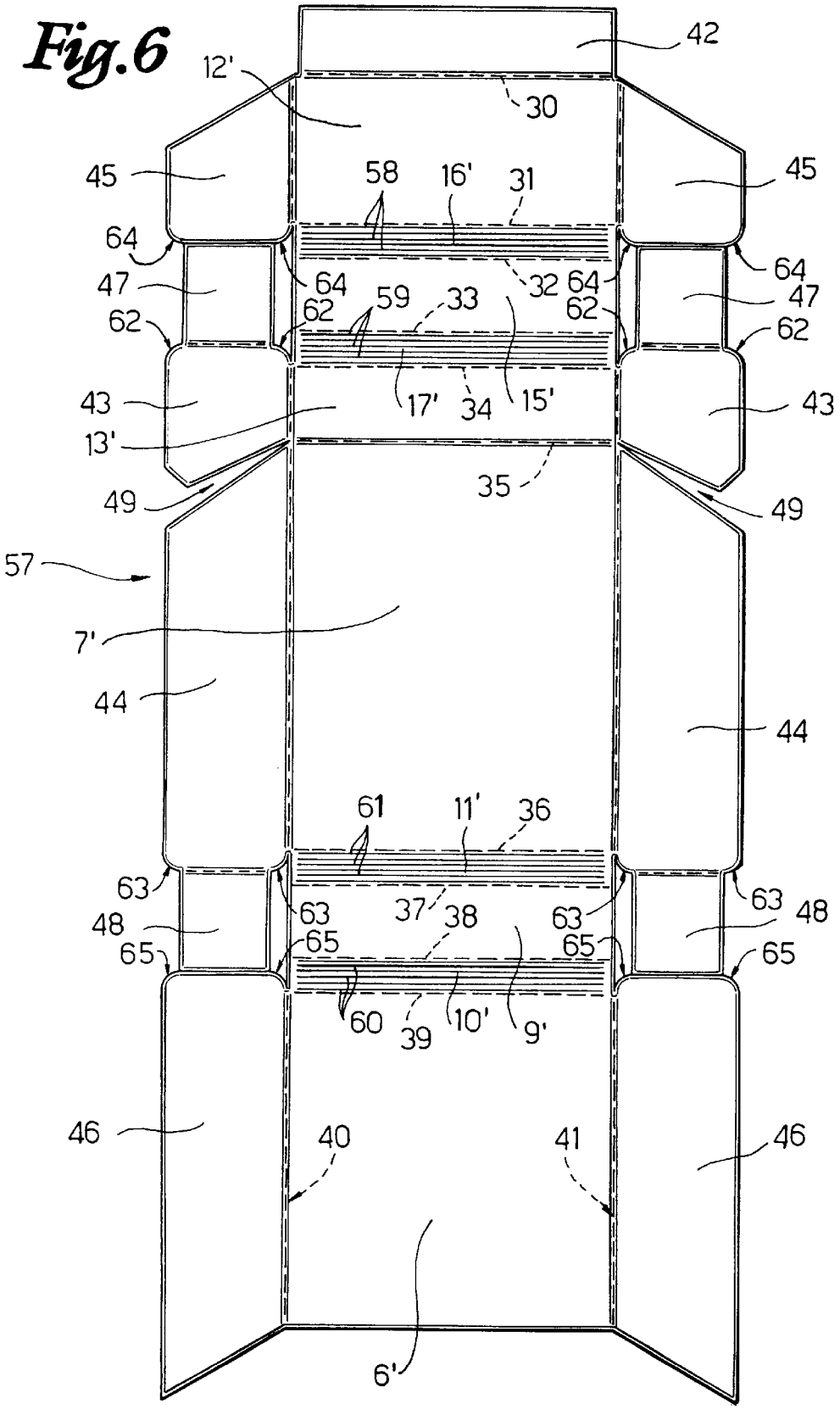
FIG. 6 shows a spreadout view of a blank from which to form the FIG. 4 packet.

FIGS. 4 and 5 show a packet 56 much the same as packet 1, and the component parts of which are indicated, wherever possible, using the same reference numbers as for the corresponding parts of packet 1.

Unlike packet 1, connecting walls 10, 11, 16 and 17 are rounded beveled transverse edges with a curved cross section, so that packet 56 is formed from a blank 57, which differs from blank 29 by presenting a number of transverse weakening lines 58, 59, 60, 61 in respective panels 16', 17', 10', 11', and by appendixes 47 and 48 being connected to respective tabs 43 and 44 by respective circular connecting edges or bevels 62 and 63 subtended by a 90° angle and presenting a radius equal to the distance between lines 33 and 34 and lines 36 and 37 respectively. Consequently, tabs 45 and 46 also present, along the respective transverse end edges and close to respective lines 32 and 38, respective circular connecting edges or bevels 64 and 65 subtended by a 90° angle and presenting the same radius as respective circular edges 62 and 63.

According to variations not shown, one or more of the longitudinal edges of packets 1 and 56 may be beveled or rounded.

We claim:

1. A rigid cigarette packet with a hinged lid for containing a group of cigarettes, the packet comprising a cup-shaped bottom container and a cup-shaped lid hinged to an open top end of the container so as to rotate between an open position and a closed position respectively opening and closing the container; the packet being substantially in the form of a rectangular parallelepipedon, and comprising a front wall, a rear wall facing parallel to the front wall, two lateral walls parallel to each other and perpendicular to the front wall and the rear wall, a bottom wall and a top wall parallel to each other and perpendicular to the lateral walls, the front wall, and the rear wall, four longitudinal edges defined between the lateral walls and respectively the front wall and the rear wall; two top transverse edges defined between the top wall and respectively the front wall and the rear wall; and two bottom transverse edges defined between the bottom wall and respectively the front wall and the rear wall; the bottom wall being a portion of the container, the top wall being a portion of the lid; and at least one of the four transverse edges being a beveled transverse edge; said beveled transverse edge is a flat beveled transverse edge defined by an oblique flat strip at 45° to two adjacent walls of the packet and; said oblique flat strip has two opposite end edges extending along, but detached from, respective further shaped edges of respective lateral walls of the packet.

2. A packet as claimed in claim 1, wherein the packet is formed from a flat, substantially rectangular blank having two preformed longitudinal bend lines, and a number of preformed transverse bend lines defining, between said two longitudinal bend lines and for both the container and the lid, a front panel, an end panel, and a rear panel; each front panel being provided with two opposite front longitudinal lateral tabs; each rear panel being provided with two opposite rear longitudinal lateral tabs; each front longitudinal lateral tab being aligned with a corresponding rear longitudinal lateral tab, and being superimposed on the corresponding rear longitudinal lateral tab to define a portion of a respective lateral wall of the packet; and each lateral tab in each pair of corresponding lateral tabs having, at a respective longitudinal end facing the corresponding lateral tab, a bevel defining said shaped edge with the corresponding bevel of the corresponding lateral tab.

3. A packet as claimed in claim 2, wherein, in each said pair of corresponding lateral tabs, a first said bevel is formed on a first of said corresponding lateral tabs in a position adjacent to the respective said longitudinal line; and a second said bevel is formed on a second of said corresponding lateral tabs in a position adjacent to a longitudinal edge of the second lateral tab on the opposite side to said longitudinal line.

4. A packet as claimed in claim 3, wherein the lateral tabs in each pair of corresponding lateral tabs have respective facing transverse end edges; one of the two corresponding lateral tabs comprising a longitudinal appendix extending from the respective said transverse end edge towards the other corresponding lateral tab; said bevel defining an end portion of said transverse end edge; and said appendix extending along the whole length of said transverse end edge left clear by said bevel.

5. A rigid packet comprising a cup-shaped bottom container and a cup-shaped lid hinged to an open top end of the container so as to rotate about an axis between an open position and a closed position respectively opening and closing the container; in the packet being defined a transverse direction parallel to said axis and a longitudinal direction perpendicular to said axis; the packet being substantially in the form of a parallelepipedon with at least one flat beveled transverse edge defined by a strip connecting two adjacent walls of the packet; said strip having two opposite end edges extending along, but detached from, respective further shaped edges of respective lateral walls of the packet; the packet being formed from a flat, substantially rectangular blank having two preformed longitudinal bend lines, and a number of preformed transverse bend lines defining, between said two longitudinal bend lines and for both the container and the lid, a front panel, an end panel, and a rear panel; each front panel being provided with two opposite front longitudinal lateral tabs; each rear panel being provided with two opposite rear longitudinal lateral tabs; each front longitudinal lateral tab being aligned with a corresponding rear longitudinal lateral tab, and being superimposed on the corresponding rear longitudinal lateral tab to define a portion of a respective lateral wall of the packet; and each lateral tab in each pair of corresponding lateral tabs having, at a respective longitudinal end facing the corresponding lateral tab, a bevel defining said shaped edge with the corresponding bevel of the corresponding lateral tab; in each said pair of corresponding lateral tabs, a first said bevel being formed on a first of said corresponding lateral tabs in a position adjacent to the respective said longitudinal line; and a second said bevel being formed on a second of said corresponding lateral tabs in a position adjacent to a longitudinal edge of the second lateral tab on the opposite side to said longitudinal line; the lateral tabs in each pair of corresponding lateral tabs having respective facing transverse end edges; one of the two corresponding lateral tabs comprising a longitudinal appendix extending from the respective said transverse end edge towards the other corresponding lateral tab; said bevel defining an end portion of said transverse end edge; and said appendix extending along the whole length of said transverse end edge left clear by said bevel.

6. A packet as claimed in claim 5, wherein said beveled transverse edge is a flat beveled transverse edge defined by an oblique flat strip at 45° to two adjacent walls of the packet.

7. A packet as claimed in claim 5, wherein said beveled transverse edge is a rounded beveled transverse edge defined by a curved-cross-section strip connecting two adjacent walls of the packet.

* * * * *